US007707954B2

(12) United States Patent
Thom et al.

(10) Patent No.: US 7,707,954 B2
(45) Date of Patent: May 4, 2010

(54) FLOATING DRY DOCK SYSTEM

(75) Inventors: Donald Scot Thom, Reading (GB); Denis Ganley, Auckland (NZ); Denise Ganley, legal representative, Auckland (NZ)

(73) Assignee: Welcome Inn Investments NV, Curacao (AN)

( * ) Notice: Subject to any disclaimer, the term of this patent is extended or adjusted under 35 U.S.C. 154(b) by 0 days.

(21) Appl. No.: 10/568,182

(22) PCT Filed: Aug. 11, 2004

(86) PCT No.: PCT/GB2004/003455

§ 371 (c)(1),
(2), (4) Date: Aug. 24, 2006

(87) PCT Pub. No.: WO2005/016741

PCT Pub. Date: Feb. 24, 2005

(65) Prior Publication Data

US 2007/0272139 A1 Nov. 29, 2007

(30) Foreign Application Priority Data

Aug. 13, 2003 (GB) ..... 0319019.6

(51) Int. Cl.
*B63C 1/02* (2006.01)
*B63C 7/00* (2006.01)

(52) U.S. Cl. ..... 114/46; 114/44

(58) Field of Classification Search ..... 114/44–54
See application file for complete search history.

(56) References Cited

U.S. PATENT DOCUMENTS

| | | | | |
|---|---|---|---|---|
| 87,291 | A * | 2/1869 | Richardson | 114/46 |
| 123,402 | A * | 2/1872 | Janicki | 114/48 |
| 3,412,702 | A * | 11/1968 | Mann | 114/46 |
| 3,415,212 | A * | 12/1968 | Hennig | 114/45 |
| 3,782,317 | A * | 1/1974 | Kriedt et al. | 114/52 |
| 3,895,592 | A | 7/1975 | King | |
| 3,951,087 | A | 4/1976 | Carson | |
| 4,276,846 | A * | 7/1981 | Anderson | 114/52 |
| 5,979,349 | A | 11/1999 | Dickman | |
| 6,823,809 | B2 * | 11/2004 | Hey | 114/45 |
| 2001/0015163 | A1 | 8/2001 | Powell | |
| 2002/0132537 | A1 * | 9/2002 | Hey | 441/49 |

FOREIGN PATENT DOCUMENTS

| | | |
|---|---|---|
| DE | 91 272 C | 9/1896 |
| FR | 2 273 707 A | 1/1976 |
| FR | 2 822 799 A | 10/2002 |
| SU | 740 600 A | 6/1980 |

OTHER PUBLICATIONS

International Search Report of PCT/GB2004/003455, mailed Oct. 4, 2004.

* cited by examiner

*Primary Examiner*—Daniel V Venne
(74) *Attorney, Agent, or Firm*—Nixon & Vanderhye PC

(57) ABSTRACT

A floatable dry dock includes a lifting cradle having two spaced arms pivotally mounted on a buoyant base and, one or more flotation tanks interconnecting the arms. A platform is mounted on the arms and a platform support is operable to ensure that the platform remains horizontal when the arms pivot about their pivotal attachment to the base.

9 Claims, 2 Drawing Sheets

FLOATING DRY DOCK SYSTEM

This application is the US national phase of international application PCT/GB2004/003455, filed 11 Aug. 2004, which designated the U.S. and claims priority of GB 0319019.6, filed 13 Aug. 2003, the entire contents of each of which are hereby incorporated by reference.

BACKGROUND

1. Technical Field

This invention relates to dry dock systems for use in lifting vessels out of the water for maintenance or repair purposes. Typically these types of docks can lift anything from one to several hundred tonnes.

2. Related Art

There are basically two types of dry dock. There are those comprising a lock that has at least one closable door into which the vessel is floated, and the water is drained from the lock to leave the vessel high and dry.

A second type of dry dock system comprises a floating dock that consist of a raft that is floated to a region ahead or astern of the vessel and submerged so as to be positioned beneath the vessel. The raft has floatation chambers built into the walls of the raft so that they can be purged of water by displacing the water with compressed air. A major problem with this type of dock is that the amount of required "water plane" makes these types of docks highly unstable. "Water plane" is defined as the area of water at the water air interface which is displaced by a part of the dock. In general the greater the "water plane" the greater will be the stability of the dock. As these docks lift a boat out of the water, there is considerable "water plane" provided by the engagement of the boat hull with the water, but it becomes particularly dangerous as the "water plane" decreases when the hull is lifted out of the water and eventually loses contact with the water. As the boat leaves the water this adds considerable weight to the dock with a considerable and rapid decrease in the "water plane" making the whole system extremely unstable, in the final stages of the lifting operation.

To remain within the bounds of stability, it is traditional to design the dock system so that it lifts vessels of about one half of the weight of the dock itself.

There is a need to provide dry dock facilities for small boats at local harbours, moorings, club harbours or lagoons and the like. There is also a need for providing a much cheaper design of floating dock than has been possible before and one that is easily moveable from one location to another. There is also a need to be able to produce a dry dock system that can be used to lift vessels out of the water rapidly thus saving valuable time and cost. Conventional dry dock systems do not permit the rapid lifting of vessels because of the problems due to the unstable designs associated with the "water plane" problem mentioned above.

BRIEF SUMMARY

An object of the present invention is to provide a floating dry dock that is both stable and quick to operate and which can lift vessels of up to twice its own weight.

According to an exemplary embodiment of the present invention there is provided a floatable dry dock comprising a lifting cradle having two spaced arms pivotally mounted on a buoyant base, one or more floatation tanks interconnecting the arms, and a platform mounted on the arms, and platform support means operable to ensure that the platform remains horizontal when the arms pivot about their pivotal attachment to the base.

Preferably the platform has wheels at an extremity of the platform and the platform support means comprises an arcuate track on each arm along which the wheels of the platform run when the arms are pivoted whilst maintaining the platform in a horizontal altitude.

Preferably the arms are of an arcuate shape and there is a plurality of elongate floatation tanks extending between the arms to define a part cylindrical cradle.

The base may comprise one or more elongate hulls. For example the base comprises a catamaran vessel. The base may comprise a sidewall located at each end of the hulls of the base and the pivot about which the arms rotate may be located on an axis between the hulls that extends along the length of the hulls.

There may be a single floatable cradle mounted on the base or there could be two spaced floatable cradles are mounted on the base.

The arms may also comprise inflatable buoyancy tanks.

According to a further aspect of the present invention the platform may be pivotally mounted between the arms and the platform support means may comprise pairs of extendable and contractable links, one of each pair of links being operable to expand when the other link of the pair contracts and the links being operable to ensure that the platform remains horizontal relative to its axis of pivotal mounting on the arms.

In this latter mentioned embodiment the platform may be of generally rectangular shape and one link of each pair of links is provided at a corner of the platform and the other link of each pair of links is provided at a respective opposite corner of the platform.

Again in this latter mentioned embodiment the arms may be elongate arms mounted at one end on the base and having a buoyancy tank provide at a second end of the arms, and the platform is mounted on a pivot at a region intermediate the ends of the arm.

BRIEF DESCRIPTION OF THE DRAWINGS

The invention will now be described by way of example with reference to the accompanying drawings in which.

DETAILED DESCRIPTION OF EXEMPLARY EMBODIMENTS

Figures 1, 2:
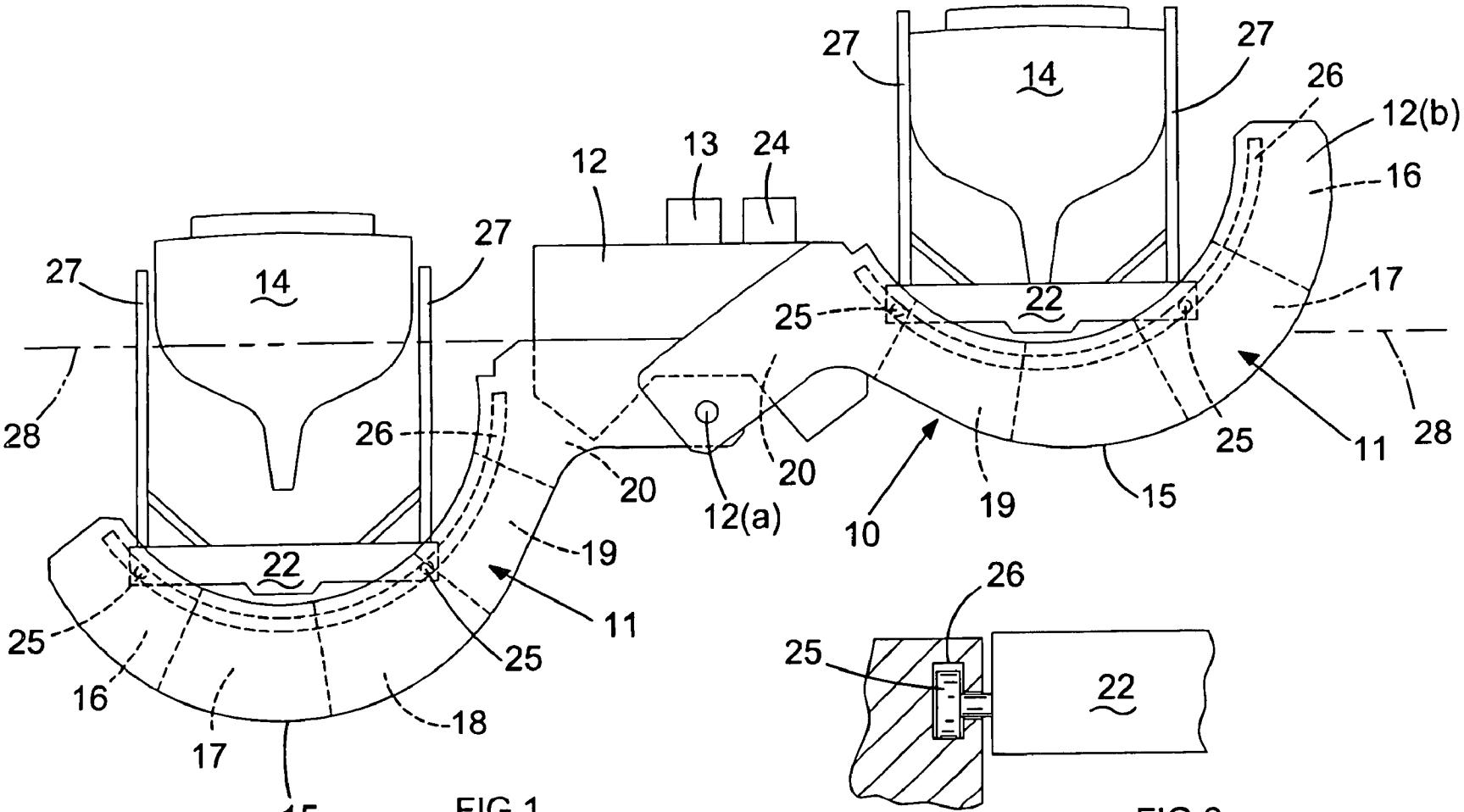
FIG. 1 is a schematic side view of a floatable dry dock constructed in accordance with the present invention having two lifting cradles.
FIG. 2 shows a part-sectional view through a wheel and track of one of the arms of the dry dock shown in FIG. 1.

Referring to FIG. 1, there is shown a dry dock 10 that has two lifting cradles 11 mounted on a common floatable base 12. However, it is to be understood that the present invention is applicable to dry docks 10 where there is only one lifting cradle mounted on the base 12. In the following description only one of the lifting cradles 11 will be described in detail but it is to be understood that the other lifting cradle 11 is of an identical or similar construction unless the context says otherwise.

Referring specifically to FIG. 1, the base 12 is in the form of an elongate twin-hull catamaran made of lightweight marine alloy or steel. The base 12 could be a mono-hull or a cylindrical float or other floatable structure such as for example a trimaran.

Mounted on the base 12 are the engines and , propulsion equipment (not shown), and all the controls and services 13 for piloting the base 12 to a location adjacent a vessel 14 to be lifted. The services 13 include pumps for flooding and emptying buoyancy tanks of the lifting cradles (to be described hereinafter) and other services.

Each lifting cradle 11 comprises to arms 15 pivotally mounted on pivotal mountings 12(*a*) in sidewalls of the base 12. The pivots (12(*a*)are located on an axis between the two hulls the catamaran base 12 that extends in a direction along the length of the hulls of the base. The arms 15 are made of a lightweight marine alloy or steel construction and are of an arcuate shape and have elongate buoyancy tanks 16 to 20 (shown dotted) extending between the two arms 15 to define a part-cylindrical cradle 11, which when lowered (as will be explained later), enables the vessel 14 to be floated in from one end of the cradle 11.

The tanks 16 to 20 have means for selectively flooding the tanks 16 to 20 with water in sequence to cause the cradle 11 to submerge and cause the arms 15 to pivot about pivots 12(*a*) and become submerged. The tanks are connected to a source 24 of compressed air whereby they can be purged of water and filled with compressed air to vary the buoyancy of the cradle 11. The arms 15 may also incorporate buoyancy tanks (not shown).

The arms 15 have a platform support means in the form of an arcuate track 26 running along, and adjacent to, the concave edge of the arms 15 for supporting a lifting platform 22. The lifting platform 22 has wheels 25 at each lateral extremity (see FIG. 2) that run in the tracks 26. The shape of the arcuate tracks 26, and the position of the wheels 25 on the platform 22, is arranged so that the platform 22 remains stable and horizontal as the arms 15 rotate about the pivotal means 12(*a*).

As the arms 15 pivot upwards and downwards, the platform 22, whilst remaining horizontal moves in a horizontal direction towards or away from the base 12.

In order to stabilise the vessel 14 during lifting or lowering of the arms 15, the platform 22 is provided with supports 27 that are initially spaced apart and secured to the platform 22 at a width slightly wider than the width of the vessel 14. The supports 27 can be of a height that enables them to project out of the water (as shown on the left hand side of FIG. 1) so that the pilot can steer the vessel 14 into position between the supports 27 when the cradle 11 is submerged. The supports 27 are positioned at equal distance from a plane of symmetry of the platform 22 so that the vessel 14 is located above the centre of gravity of the platform 22 to avoid tilting of the platform 22 during lifting or lowering of the arms 15.

In operation, the dry dock 10 is floated out to where the vessel 14 to be lifted is located, or the vessel 14 is floated to the vicinity of the dry dock 10. The dry dock is positioned either astern or ahead of vessel 14. The tanks 16 to 20 of the cradle 11 are flooded with water to submerge the platform 22 to a position where the vessel 14 can be floated into position between the supports 27 from one end of the cradle 11. This position is shown in the left hand side of FIG. 1.

With the vessel 14 in place above the platform 22, the tanks 16 to 20 are sequentially purged of water by pumping in compressed air to increase the buoyancy of the cradle 11 in a controlled manner. Firstly, tank 16 is supplied with compressed air then tank 17 followed in sequence by the tanks 18, 19, and 20. This causes the arms 15 to rise by pivoting about the pivotal connection 12(*a*). The upward movement of the arms 15 from a submerged position as shown in the left hand side of FIG. 1 towards the position shown in the right hand side of FIG. 1 is continued until the vessel 14 is lifted clear of the water surface 28.

In order to lower the vessel 14 after repair and maintenance from the position shown in the right hand side of FIG. 1 to the position shown in the left hand side of FIG. 1, the above procedure is reversed. That is to say, the tanks 16 to 20 are flooded with water in the reverse order, starting first with tank 20 and then progressing in sequence by flooding tanks 19, 18, 17 and then finally tank 16.

During lifting and lowering of the vessel 14, the combined "water plane" (that is to say the area at the interface between the water surface and the air) of the vessel 14, the catamaran 12, the arms 15, and the tanks 16 to 20 remains reasonably constant and hence the whole of the dry dock 10 together with the vessel is very stable.

The stability of the dry dock 10 is such that it is possible to reverse the traditional factor of safety of 2:1 (that is to say the conventional limit of lifting vessels 14 of one half of the displacement of the dry dock 10). Thus with each dry dock 10 constructed in accordance with the present invention, it is possible to lift vessels 14 of twice the weight of the dry dock. This offers a significant advantage over all prior known floating dry docks.

Furthermore, each of the two cradles 11 shown in FIG. 1 can be operated independently of the other. In other words, it is unnecessary to counterbalance the lifting of one vessel 14 by lifting a second vessel 14 with the other cradle. In fact, the provision of two cradles 11 on one catamaran 12, improves stability of each, because the total "water plane" is the sum total of the "water plane" of both cradles 11, the base 12 and the vessel 14 and not just the "water plane" of one cradle 11. In situations with floating dry docks 10 that have two lifting cradles 11, where one cradle 11 is raised and the other lowered as shown in FIG. 1, the raised cradle 11 effectively converts the catamaran base 12 into a trimaran with an outer rigger formed by the raised cradle 11. Therefore, since each cradle 11 is very stable to start with (compared with prior known dry docks) the stability of the whole is further enhanced with two lifting cradles 11.

In FIG. 1 there is shown two cradles 11, but as explained above, it is not essential to build two cradles on each base 12.

In the above example the platform 22 has wheels 25 that run in arcuate tracks 26 on the arms 15. Whilst this is the preferred way of mounting the platform 22, it is possible to mount the platform 22 on pivots 31 at each end of its axis of symmetry instead of mounting them in the arcuate tracks 26. This is shown schematically in FIG. 3.

Figure 3:
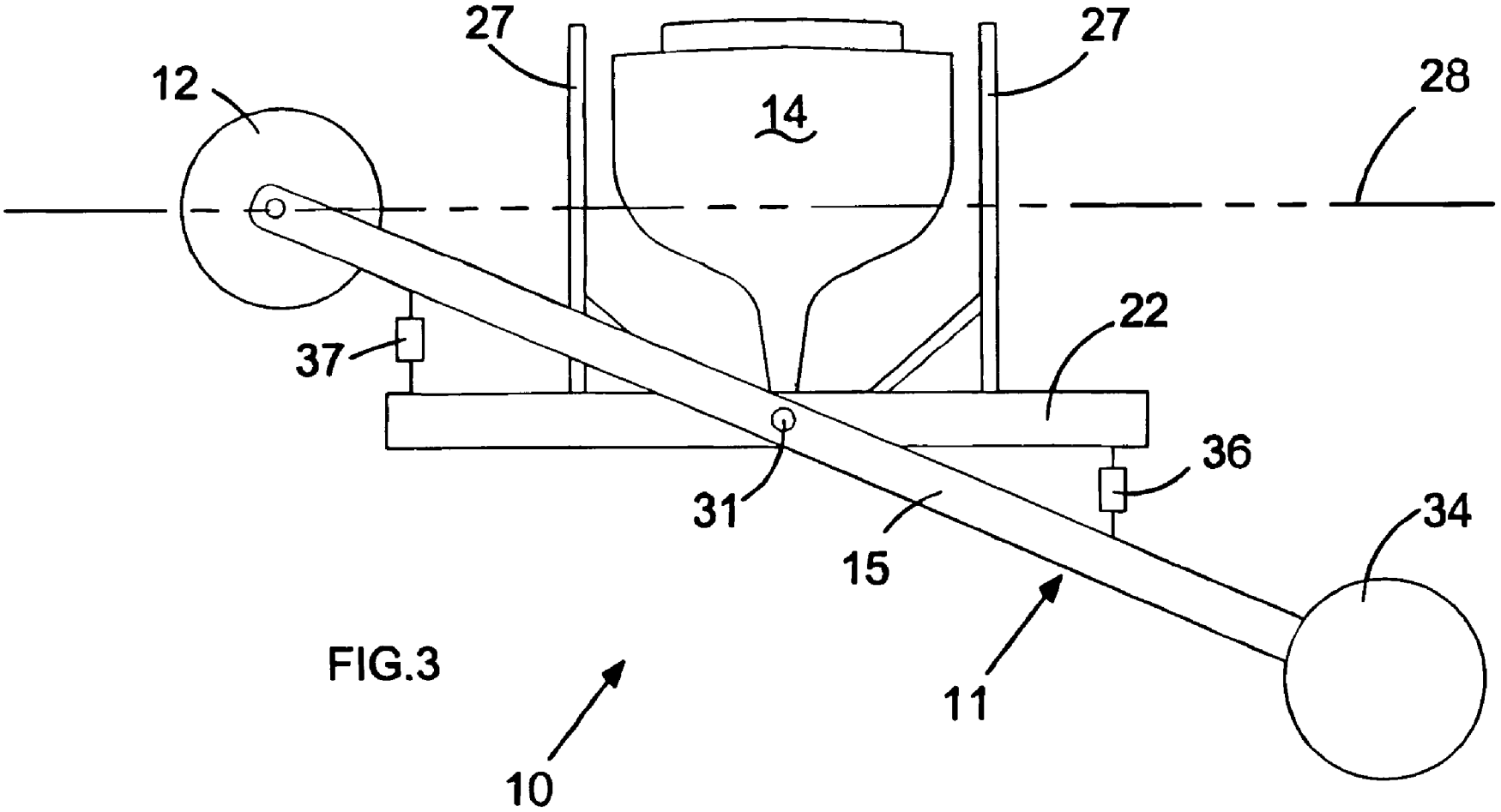
FIG. 3 is a side view of a second embodiment of the present invention.

Referring to FIG. 3 the platform 22 is of generally rectangular shape and the arms 15 need not be of an arcuate shape but could simply be elongate arms 15 as shown. In this case, the cradle 11 may simply comprise the two arms 15 interconnected by a single buoyancy tank 34 at a free end of the arms 15.

In order to maintain the platform 22 in a horizontal and stable state, the corners of the platform 22 are interconnected to each of the arms 15 by way of a platform support means in the form of pairs of links 36, 37. The links 36, 37 of each pair may be in the form of hydraulic pistons that are interlinked so that the links 36 expand whilst the links 37 contract when the arm 55 is raised by introducing compressed air into the tank 34. During lowering of the cradle 11 the tank 34 is flooded in a controlled manner and the links 37 expand whilst the links 36 contract thereby ensuring that the platform 22 remains horizontal throughout all movements of the arms 15. In this case, the centre of gravity of the platform 22 remains at a fixed radius relative to the pivot about which the arms 15 rotate.

What is claimed is:

1. A floatable dry dock comprising:

a lifting cradle having two spaced arms pivotally mounted on a buoyant base, one or more floatation tanks interconnecting the arms, a platform mounted on the arms, and platform support means operable to ensure that the platform remains horizontal when the arms pivot about their pivot mount on the base, wherein the platform has wheels at an extremity of the platform and the platform support means comprises an arcuate track on each arm along which the wheels of the platform run when the arms are pivoted while maintaining the platform in a horizontal attitude;

whereby the floatation tanks may be flooded with water to lower the platform and enable a vessel to float into position over the platform, and purged of water to lift the vessel clear of the water.

2. A dry dock as in claim 1 wherein the arms are of an arcuate shape and there is a plurality of elongate flotation tanks extending between the arms to define a part cylindrical cradle.

3. A dry dock as in claim 1 wherein a single floatable cradle is mounted on the base.

4. A dry dock as in claim 1 wherein two spaced floatable cradles are mounted on the base.

5. A dry dock as in claim 1 wherein the arms comprise inflatable buoyancy tanks.

6. A dry dock according to claim 2 wherein the base comprises one or more elongate hulls.

7. A dry dock as in claim 6 wherein the base comprises a sidewall located at each end of the base and a pivot about which the arms rotate is located on a longitudinal axis of the base.

8. A dry dock as in claim 6 wherein the base comprises a catamaran vessel.

9. A dry dock as in claim 8 wherein the base comprises a sidewall located at each end of hulls of the base and a pivot about which the arms rotate is located on an axis between the hulls that extends along a length of the hulls.

* * * * *